US009285814B1

(12) United States Patent
Agarwal

(10) Patent No.: US 9,285,814 B1
(45) Date of Patent: Mar. 15, 2016

(54) FEEDBACK PATH FOR FAST RESPONSE TO TRANSIENTS IN VOLTAGE REGULATORS

(71) Applicant: Cirrus Logic, Inc., Austin, TX (US)

(72) Inventor: Shatam Agarwal, Austin, TX (US)

(73) Assignee: CIRRUS LOGIC, INC., Austin, TX (US)

( * ) Notice: Subject to any disclaimer, the term of this patent is extended or adjusted under 35 U.S.C. 154(b) by 36 days.

(21) Appl. No.: 14/472,110

(22) Filed: Aug. 28, 2014

(51) Int. Cl.
*G05F 1/56* (2006.01)
*G05F 1/575* (2006.01)

(52) U.S. Cl.
CPC ..... *G05F 1/575* (2013.01)

(58) Field of Classification Search
CPC ..... G05F 1/56; G05F 1/575; G05F 3/24; H02M 3/156; H02M 3/157
USPC ..... 323/265, 273, 276, 280, 282, 283, 351
See application file for complete search history.

(56) References Cited

U.S. PATENT DOCUMENTS 5,212,616 A * 5/1993 Dhong ..... H01L 27/0921 257/E27.063
5,912,552 A * 6/1999 Tateishi ..... H02M 3/1588 323/224
6,465,993 B1 * 10/2002 Clarkin ..... H02M 3/156 323/272
6,819,163 B1 * 11/2004 Gregoire, Jr. ..... G05F 3/262 327/536
6,977,490 B1 * 12/2005 Zhang ..... G05F 1/575 323/280
8,519,692 B2 8/2013 Nakashima
8,525,595 B2 * 9/2013 Berchtold ..... H03F 1/0238 330/296
8,692,529 B1 * 4/2014 Wyatt ..... G05F 1/56 323/270
2002/0093316 A1 * 7/2002 Fahrenbruch ..... G05F 1/565 323/273
2006/0125455 A1 * 6/2006 Tiew ..... H02M 3/156 323/282
2007/0241728 A1 10/2007 Demolli
2008/0094045 A1 * 4/2008 Lin ..... G05F 1/56 323/274
2009/0001953 A1 * 1/2009 Huang ..... G05F 1/575 323/281
2010/0253303 A1 * 10/2010 Chern ..... G05F 1/56 323/282
2013/0307506 A1 * 11/2013 Oh ..... G05F 1/10 323/282

* cited by examiner

*Primary Examiner* — Adolf Berhane
(74) *Attorney, Agent, or Firm* — Norton Rose Fulbright US LLP

(57) ABSTRACT

A feedback path may be provided within the voltage regulator to reduce the effect of a current step or load transient on the output of a voltage regulator. The feedback path may provide a fast path for stabilizing the voltage regulator after the load transient. The feedback path may be configurable to be activated or de-activated during operation of the voltage regulator. The feedback path may be activated when the voltage regulator takes over generation of an output voltage from another voltage regulator. The feedback path may then be de-activated to allow normal operation of the voltage regulator after a steady-state condition is reached.

21 Claims, 7 Drawing Sheets

FEEDBACK PATH FOR FAST RESPONSE TO TRANSIENTS IN VOLTAGE REGULATORS

FIELD OF THE DISCLOSURE

The instant disclosure relates to power supplies. More specifically, this disclosure relates to supply voltage regulation.

BACKGROUND

Voltage regulators are important components of consumer electronic devices and other electronic devices. A voltage regulator provides a nearly constant voltage output level at a particular connection. For example, a nearly constant voltage may be provided to a backlight of a liquid crystal display (LCD) of an electronic device. In another example, a nearly constant voltage may be provided to an output node to detect the presence, or not, of an attached device. Multiple voltage regulators may be present in electronic devices. In some configurations, multiple voltage regulators are coupled to the same output node and operated in tandem to provide different voltage levels at that output node.

A voltage regulator may be capable of producing multiple levels of a nearly constant voltage output. However, the range of levels available from a voltage regulator may be limited. Further, different voltage regulators may be more or less efficient in different ranges of voltage output levels. Thus, for example, two voltage regulators may be coupled to an output node when a desired output voltage range for the node is 0-3 Volts. A first voltage regulator may provide the output voltage for a low portion of the 0-3 Volt range, and a second voltage regulator may provide the output voltage for a high portion of the 0-3 Volt range. An example of this arrangement is shown in FIG. 1.

FIG. 1 is a block diagram illustrating multiple voltage regulators coupled to an output node according to the prior art. A first voltage regulator 102 may be coupled to an output node 106, and a second voltage regulator 104 may also be coupled to the output node 106. The first voltage regulator 102 may be configurable to provide output levels of 1.86, 2.0, and 2.3 Volts. The second voltage regulator 104 may provide an output level of 2.75 Volts. When a low output voltage is desired at the output node 106, the first regulator 102 may be active and driving the output node 106 to the desired low output voltage. When a high output voltage is desired at the output node 106, the second regulator 104 may be active and driving the output node 106. Thus, the driver of the output node 106 may switch back and forth between the first regulator 102 and the second regulator 104. When one of the regulators 102 and 104 switches on to become the driver for the output node 106, the regulator experiences a current step at its output. That is, when one of the regulators 102 and 104 is off then it is not outputting any current. However, when the regulator 102 or 104 switches on, then it must immediately begin providing current at a level required by the device connected to the output node 106. The abrupt increase in current output by the regulator 102 or 104, referred to as a current step, may result in undesirable behavior at the output node 106.

FIG. 2 is a graph illustrating a result of a current step on the nearly constant voltage output at an output node according to the prior art. A line 202 illustrates a voltage output at the output node 106 of FIG. 1. Lines 204 and 206 illustrate nearly constant voltages $V_2$ and $V_1$ generated by the regulators 104 and 102, respectively. Prior to time 212, the second regulator 104 is driving the output node 106 at voltage $V_2$ of line 204. At time 212, the first voltage regulator 102 takes over driving the output node 106. The current step at the output of the first voltage regulator 102 causes a droop 222 in the output voltage of line 202 during time period 216. After a transition time period 216, the voltage of line 202 eventually stabilizes at voltage $V_1$ of line 206. The transition time period 216 can be a relatively long period during which the droop 222 may cause errors in the electronic device. One source of the droop 222 is the limited bandwidth of an amplifier within the voltage regulator 102 or 104. Another source of the droop 222 is a slow transition time for the gate voltage of pass transistors 102B and 104B coupled to amplifiers 102A and 102B, respectively, of the regulators 102 and 104. This slow transition is shown in line 208 of FIG. 2 showing the gate voltage stabilizing during the transition time period 216.

One example of an error may be illustrated with a headset for mobile device, such as a cellular phone or a media player. A $V_{MICBIAS}$ voltage may be supplied to a third terminal of a headphone jack of the mobile device (where the first and second terminals provide audio to the headphones). This bias voltage allows a microphone in line with the headphones to record sounds from the environment, such as a person speaking over the telephone. Additionally, a measurement of the voltage may be used to determine whether a headset is connected to the headphone jack. The droop 222 of $V_{MICBIAS}$ voltage 202 shown in FIG. 2 may cause erroneous operation of the microphone or may cause erroneous detection of the presence or absence of a headset. These errors may affect operation of the mobile device. For example, erroneous microphone operation may cause speech during a telephone call to be corrupted. In another example, erroneous headset detection may cause the mobile device to incorrectly turn on or turn off speakerphone operation of the mobile device.

Shortcomings mentioned here are only representative and are included simply to highlight that a need exists for improved voltage regulators, particularly for audio devices and other consumer-level devices. Embodiments described here address certain shortcomings but not necessarily each and every one described here or known in the art.

SUMMARY

A feedback path may be provided within the voltage regulator to reduce the effect of a current step on the output of a voltage regulator. Thus, the voltage droop at the output node may be decreased. The feedback path may be configurable to be activated or de-activated during operation of the voltage regulator. For example, the feedback path may be activated to allow the voltage regulator to quickly adapt to the current step when the voltage regulator begins driving the output node. The feedback path may then be de-activated to allow normal operation of the voltage regulator after a steady-state condition is reached. This feedback path may be combined with an always-activated second feedback path to further improve response of the voltage regulator to the current step and reduce voltage droop at the output node.

According to one embodiment, an apparatus may include a voltage regulator having a transistor comprising a gate, a source, and a drain; an amplifier comprising an input node and an output node, wherein the output node is coupled to the gate of the transistor; a first feedback path coupling one of the source and the drain of the transistor to the gate of the transistor; and/or a second feedback path coupling one of the source and the drain of the transistor to the input node of the amplifier. The first feedback path may be configured to activate and de-activate, and specifically to de-activate during steady-state operation of voltage regulator.

In some embodiments, the apparatus may also include a controller coupled to the first feedback path and configured to de-activate the first feedback path during steady-state operation of the voltage regulator and/or activate the first feedback path during a load transient on the one of the source and the drain of the transistor, wherein the first feedback path remains active for a duration of time after the load transient.

In certain embodiments, the first feedback path may include a switch and/or a capacitor, wherein the switch and the capacitor are coupled in series between the gate of the transistor and the one of the source and the drain of the transistor; the transistor may be a p-channel metal-oxide-semiconductor (PMOS) transistor; the voltage regulator may be a low-dropout regulator (LDO); the transistor may be an n-channel metal-oxide-semiconductor (NMOS) transistor; the voltage regulator may be a linear voltage regulator; and/or the first feedback path further may be a current mirror.

According to another embodiment, a method may include detecting a load transient on a voltage regulator having a transistor; activating, after detecting the load transient, a feedback path between one of a drain and a source of the transistor and a gate of the transistor; and/or de-activating the feedback path after a duration of time after the load transient such that the feedback path is not active during steady-state operation of the voltage regulator.

In certain embodiments, the step of activating the feedback path may include toggling a switch in the feedback path to couple a capacitor between the gate of the transistor and the one of the drain and the source of the transistor; the step of activating the feedback path may include increasing transient gate-to-source voltage of the transistor using the capacitor to reduce the load transient on the voltage regulator, wherein the voltage regulator comprises a low-dropout (LDO) regulator; the step of activating the feedback path may include increasing a gate-to-source voltage of the transistor using a current mirror in the feedback path to reduce the load transient on the voltage regulator, wherein the voltage regulator comprises a linear voltage regulator; the step of de-activating the feedback path may include de-activating the feedback path after a predetermined duration of time; the step of detecting the load transient may include detecting a switching from another voltage regulator to the voltage regulator at an output node shared by the voltage regulator and the other voltage regulator; and/or the step of detecting the switching from another voltage regulator to the voltage regulator may include detecting a switching from a first low-dropout regulator (first LDO) to a second low-dropout regulator (second LDO).

According to a further embodiment, an apparatus may include a voltage regulator having a transistor and a feedback path between one of a drain and a source of the transistor and a gate of the transistor; and a controller coupled to the voltage regulator, wherein the controller is configured to execute the steps of detecting a load transient on the voltage regulator; activating, after detecting the load transient, the feedback path; and/or de-activating the feedback path after a duration of time after the load transient such that the feedback path is not active during steady state operation of the voltage regulator.

In certain embodiments, the feedback path may include a switch and a capacitor, wherein the switch and the capacitor are coupled in series between the gate of the transistor and the one of the source and the drain of the transistor; the controller may be configured to activate the feedback path by toggling the switch; the voltage regulator may be configured to couple to a load, wherein the apparatus further comprises another voltage regulator configured to couple to the load, and wherein the controller is further configured to detect the load transient by detecting a switch in operation from the other voltage regulator to the voltage regulator; the voltage regulator and the other voltage regulator may be configured to couple to a microphone bias output node; and/or the transistor may be an n-channel metal-oxide-semiconductor (NMOS) transistor, and wherein the feedback path further comprises a current mirror configured to increase a gate-to-source voltage of the NMOS transistor when the feedback path is active.

The foregoing has outlined rather broadly certain features and technical advantages of embodiments of the present invention in order that the detailed description that follows may be better understood. Additional features and advantages will be described hereinafter that form the subject of the claims of the invention. It should be appreciated by those having ordinary skill in the art that the conception and specific embodiment disclosed may be readily utilized as a basis for modifying or designing other structures for carrying out the same or similar purposes. It should also be realized by those having ordinary skill in the art that such equivalent constructions do not depart from the spirit and scope of the invention as set forth in the appended claims. Additional features will be better understood from the following description when considered in connection with the accompanying figures. It is to be expressly understood, however, that each of the figures is provided for the purpose of illustration and description only and is not intended to limit the present invention.

BRIEF DESCRIPTION OF THE DRAWINGS

For a more complete understanding of the disclosed system and methods, reference is now made to the following descriptions taken in conjunction with the accompanying drawings.

DETAILED DESCRIPTION

Figure 3:
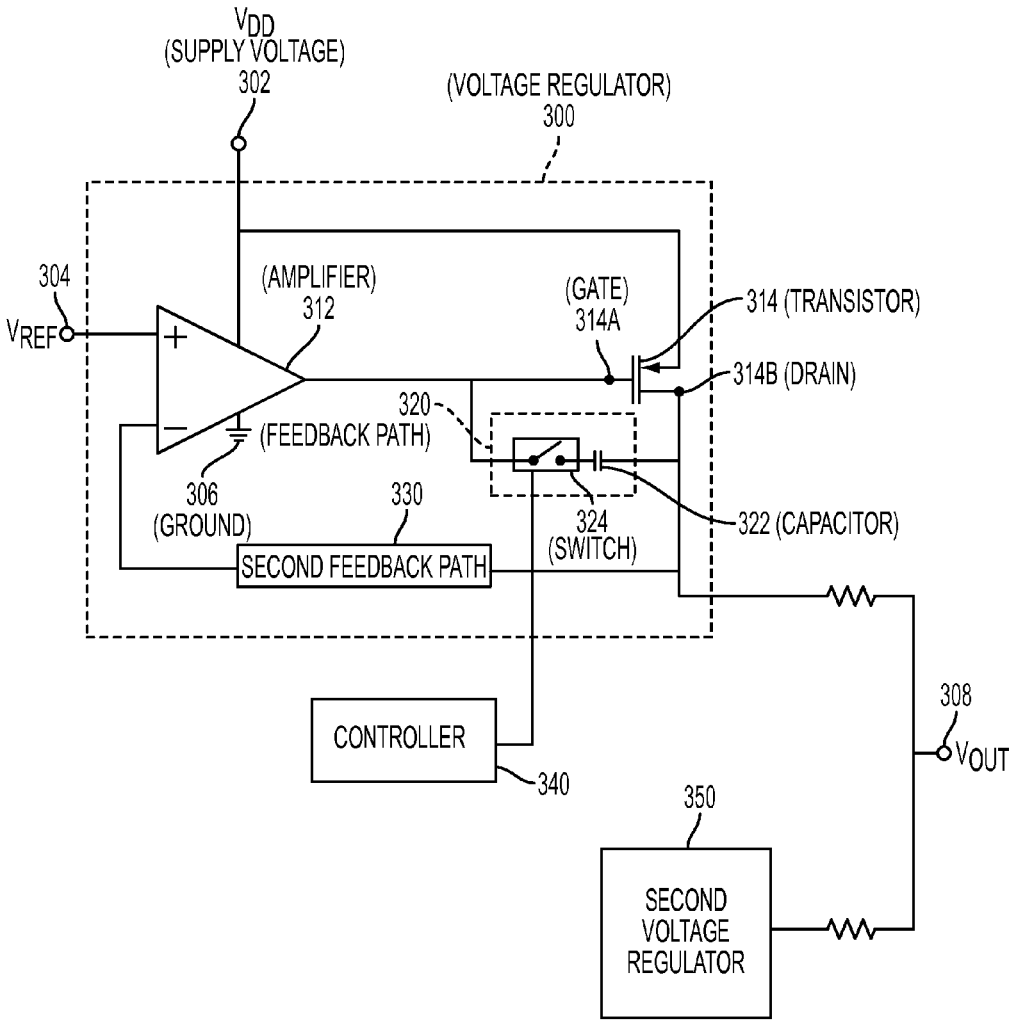
FIG. 3 is a circuit schematic illustrating a voltage regulator with a configurable feedback path according to one embodiment of the disclosure.

FIG. 3 is a circuit schematic illustrating a voltage regulator with a configurable feedback path according to one embodiment of the disclosure. A voltage regulator 300, such as a low drop-out (LDO) regulator, may be coupled to an output node 308 to provide an output voltage $V_{OUT}$. In some embodiments, a second voltage regulator 350 may also be coupled to the output node 308. In one embodiment, the output node 308 may be coupled to a microphone bias terminal of a headphone jack, and the output voltage $V_{OUT}$, may be the microphone bias voltage $V_{MICBIAS}$. The $V_{MICBIAS}$ voltage may be used to detect the presence or absence of headphones connected to the headphone jack and may be used to operate the microphone of the headphones.

Each of the voltage regulators 300 and 350 may be configured to include the components illustrated within the voltage regulator 300, or the voltage regulators 300 and 350 may be differently configured. A ground 306 and a supply voltage $V_{DD}$ at an input node 302 may be provided for powering various components of the voltage regulator 300. The voltage regulator 300 may receive a reference voltage $V_{REF}$ at input node 304, which may provide a signal to control an output of the voltage regulator 300 at output node 308.

Figure 6:
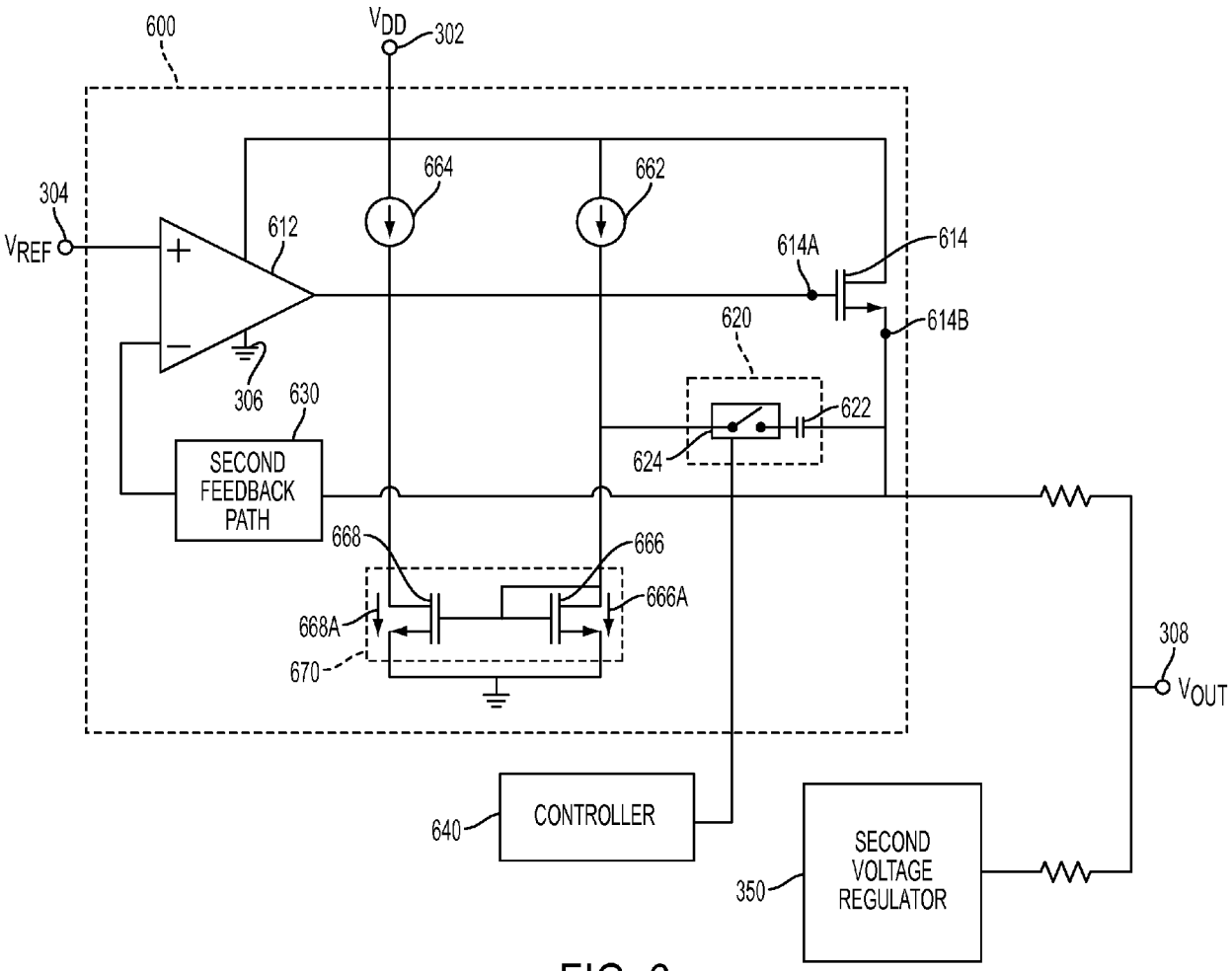
FIG. 6 is a circuit schematic illustrating a voltage regulator having an n-channel transistor with a configurable feedback path according to one embodiment of the disclosure.

The voltage regulator 300 may include an amplifier 312 and a transistor 314. In the embodiment shown in FIG. 3, the transistor 314 may be a p-type metal-oxide-semiconductor (PMOS) transistor. In other embodiments, the transistor 314 may be different types of transistors, such as an NMOS transistor as illustrated in FIG. 6. An output of the amplifier 312 may be coupled to a gate 314A of the transistor 314. A drain 314B of the transistor 314 may be coupled to the output node 308 for providing the output voltage $V_{OUT}$. The drain 314B may also be coupled through various feedback paths to other terminals within the voltage regulator 300. For example, a first feedback path 320 may couple the drain 314B of the transistor 314 to a gate 314A of the transistor 314. In another example, a second feedback path 330 may couple the drain 314B of the transistor 314 to a terminal of the amplifier 312.

The feedback path 320 coupling the drain 314B to the gate 314A may include components such as, for example, switch 324 and capacitor 322. A controller 340 may be configured to activate and de-activate the feedback path 320 by toggling the switch 324. The controller 340 may be internal or external (as shown) to the voltage regulator 300. When the switch 324 is toggled into a conducting state, the feedback path 320 electrically couples the gate 314A to the drain 314B. Coupling the gate 314A to the drain 314B causes a voltage across the gate 314A and the drain 314B to become approximately zero. As this voltage reaches approximately zero, the gate-source voltage $V_{GS}$ across the transistor 314 increases, and thus the current increases through the transistor 314 from the supply voltage $V_{DD}$ at input node 302 to the output voltage $V_{OUT}$ at output node 308. An increasing current through the transistor 314 may allow maintaining the output voltage $V_{OUT}$ at output node 308 with a reduced droop. For example, when a current step is loaded on the voltage regulator 300, such as when the voltage regulator 300 begins driving the output node 308, the output voltage $V_{OUT}$ may droop as the voltage regulator 300 ramps up to meet the demand of the current step. Coupling the gate 314A through the switch 324 to the drain 314B may increase current through the transistor 314 and allow the voltage regulator 300 to more quickly ramp up to meet the demand of the current step. The switch 324 located in the feedback path 320 may allow the feedback path 320 to be de-activated during steady-state operation of the voltage regulator 300, such as a duration of time after the current step occurs.

Figure 4:
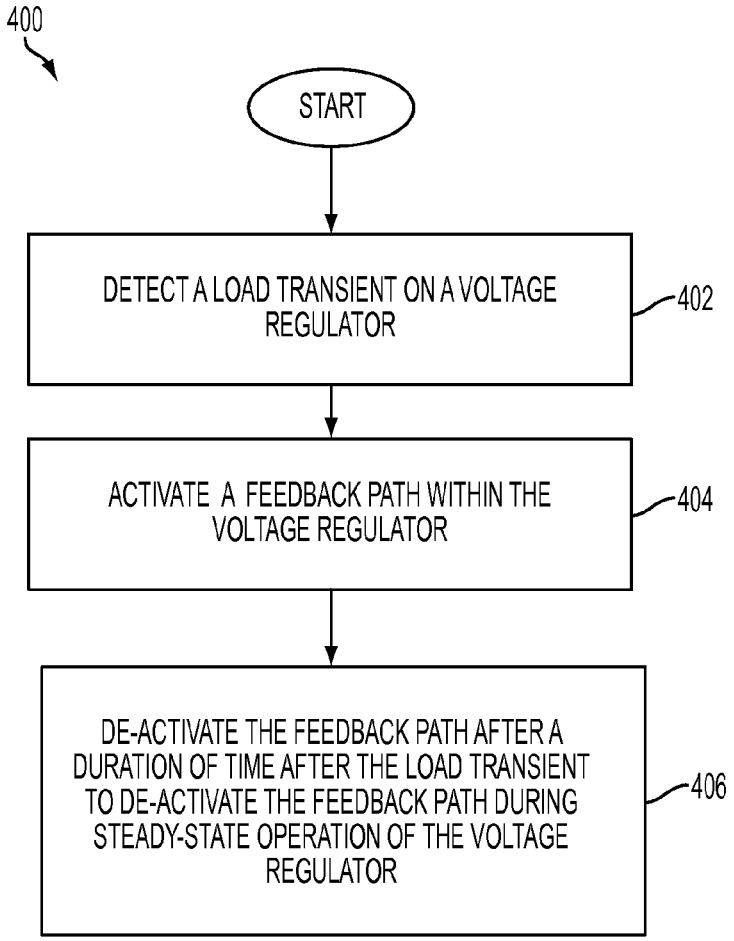
FIG. 4 is a flow chart illustrating operation of a voltage regulator with a configurable feedback path according to one embodiment of the disclosure.

The controller 340 may control operation of the feedback path 320 to maintain a desired output voltage $V_{OUT}$ at output node 308 with reduced droop. FIG. 4 is a flow chart illustrating operation of a voltage regulator with a configurable feedback path according to one embodiment of the disclosure. A method 400 may begin at block 402 with detecting a load transient on the voltage regulator 300. The controller 340 may monitor the output voltage $V_{OUT}$ at output node 308 to detect changes indicating a load transient, such as a current step, on the voltage regulator 300. The controller 340 may alternatively or additionally monitor parameters within the voltage regulator 300, such as a voltage at the drain 314B, to detect a load transient. When a load transient is detected at block 402, the controller 340 may activate the feedback path 320 within the voltage regulator 300. For example, block 404 may include configuring the switch 324 to a conducting state to couple the gate 314A and the drain 314B. The controller 340 may leave the feedback path 320 activated during and after the load transient until the voltage regulator 300 is operating in a steady-state condition. The duration of time the feedback path 320 remains active may be a fixed duration of time, such as approximately 100 milliseconds, or may be a dynamic duration of time determined by monitoring the output voltage $V_{OUT}$ and/or the voltage regulator 300 to detect steady-state conditions. Then, at block 406, the feedback path 320 is de-activated after an appropriate duration of time to de-activate the feedback path during steady-state operation of the voltage regulator 300. De-activation of the feedback path 320 during steady-state operation by the controller 340 may improve a power supply rejection ratio (PSRR) of the voltage regulator 300.

Figure 5:
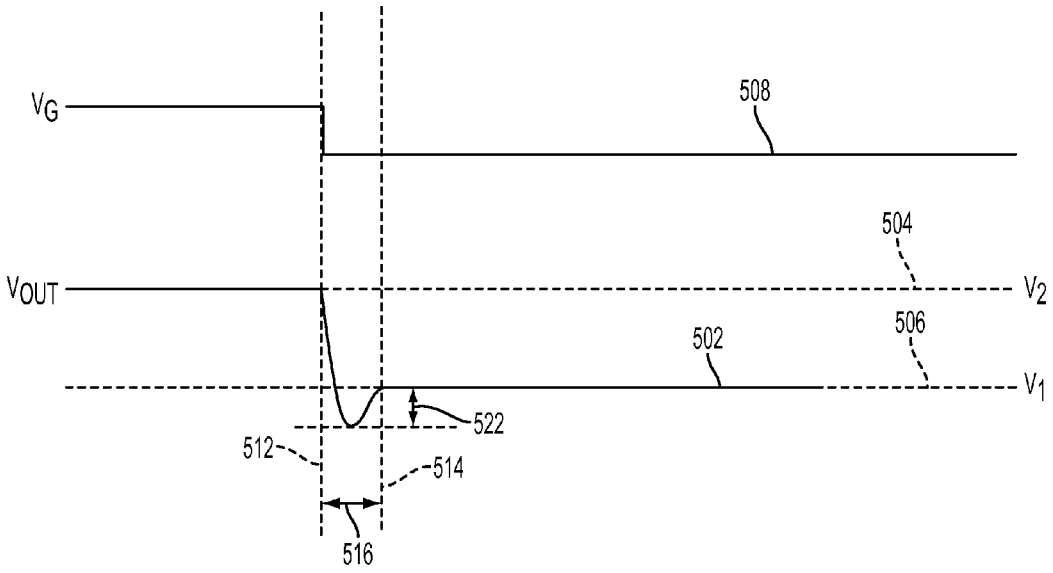
FIG. 5 is a graph illustrating a voltage output at an output node of a voltage regulator with a configurable feedback path according to one embodiment of the disclosure.

When the feedback path 320 is activated by the controller 340 during operation of the voltage regulator 300, such as during load transients or current steps, a voltage droop at the output voltage $V_{OUT}$ may be reduced. An output voltage $V_{OUT}$ with reduced droop is shown in FIG. 5. FIG. 5 is a graph illustrating a voltage output at an output node of a voltage regulator with a configurable feedback path according to one embodiment of the disclosure. A line 502 illustrates an output voltage $V_{OUT}$ at output node 308 before and after a load transient at time 512. The output voltage $V_{OUT}$ may initially be at a voltage $V_2$ 504 provided by the second voltage regulator 350 before time 512. At time 512, the voltage regulator 300 may begin driving the output voltage $V_{OUT}$ causing a load transient on the voltage regulator 300. The feedback path 320 may be activated at or shortly after time 512 to allow the voltage regulator 300 to quickly increase current to maintain a desired voltage $V_1$ shown as line 506 on the output voltage $V_{OUT}$. The current may be quickly adjusted by the feedback path by reducing a transition time for adjusting a gate voltage at the gate 314A. A line 508 showing the gate voltage $V_G$ at the gate 314A illustrates a quick transition at the beginning of the transition time period 516 created by coupling the drain 314B to the gate 314A through the feedback path 320.

Figure 1:
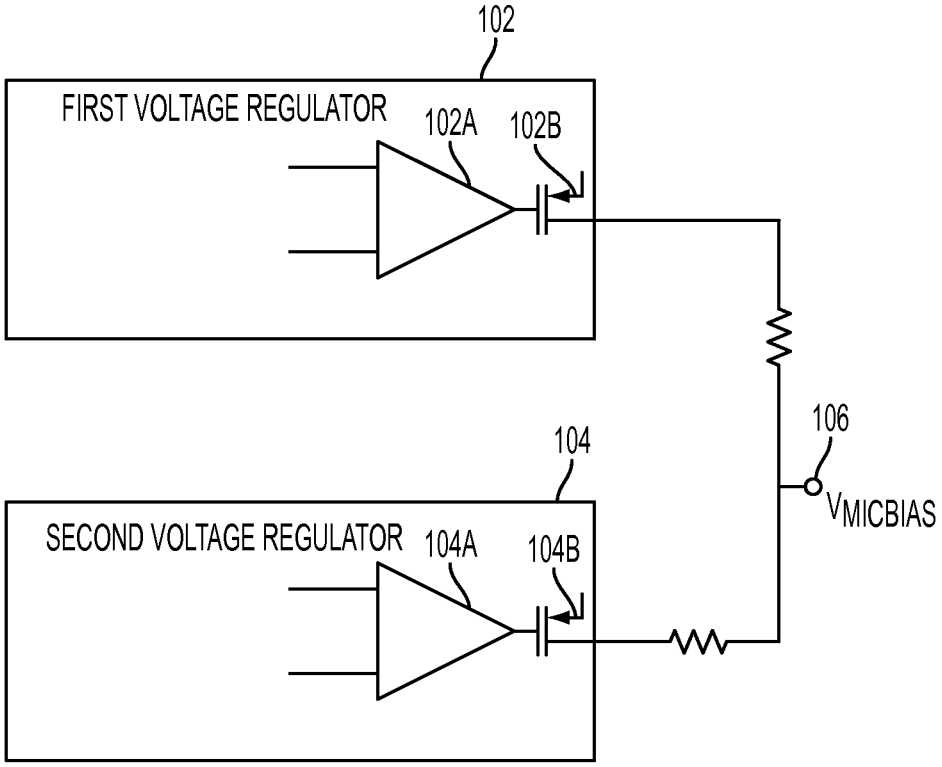
FIG. 1 PRIOR ART
FIG. 1 is a block diagram illustrating multiple voltage regulators coupled to an output node according to the prior art.
Figure 2:
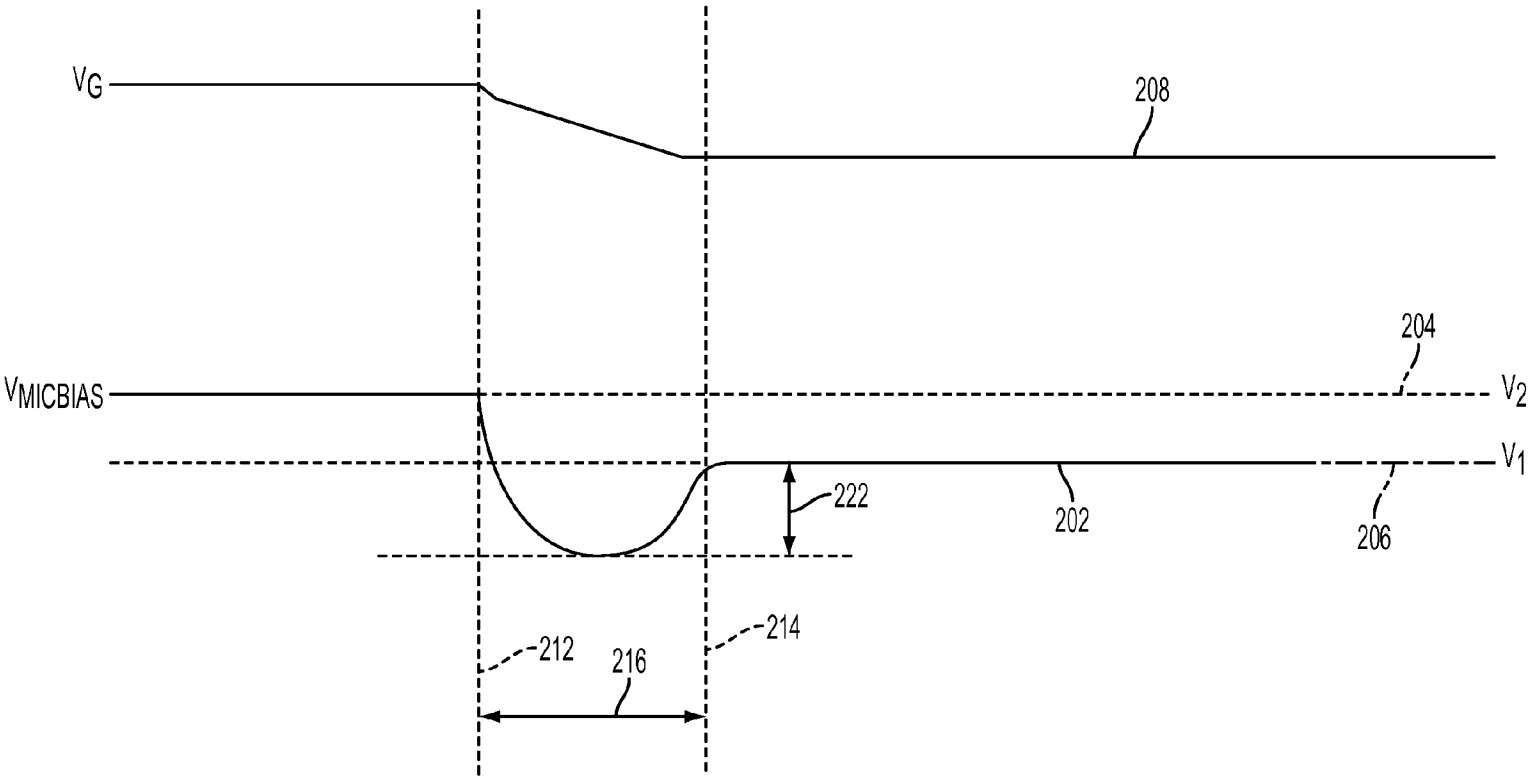
FIG. 2 PRIOR ART
FIG. 2 is a graph illustrating a result of a current step on the nearly constant voltage output at an output node according to the prior art.

A reduced droop 522 may occur during time period 516 as the voltage regulator 300 returns to a steady-state condition at 514. Steady-state condition may occur, for example, when the output voltage $V_{OUT}$ is within 5% of the desired voltage $V_1$ of line 506. The droop 522 is smaller than droop 222 of FIG. 2 for conventional circuits. Likewise, the time duration 516 of the droop 522 is shorter than the time duration 216 of droop 222 of FIG. 2 for conventional circuits. In one example, the droop 522 may be reduced from 1.5 Volts to 0.1 Volts and the duration 516 may be reduced from 10 milliseconds to 1 millisecond. As shown, the feedback path 320 in a voltage regulator reduces droop when control of the output node 308 is switched from another voltage regulator to the voltage regulator 300. However, the feedback path 320 may be implemented in any voltage regulator configuration to improve response of the voltage regulator. For example, the feedback path 320 may be activated and de-activated within the voltage regulator 300 absent the second voltage regulator 350.

The feedback path 320 described above with reference to FIG. 3 illustrates a feedback path in one embodiment for use with a PMOS transistor. A similar feedback path may be configured for use with other transistors to increase current through the transistor in a short time period and thus reduce droop of the output voltage $V_{OUT}$. For example, as illustrated in FIG. 6, a feedback path may be coupled to an n-type metal-oxide-semiconductor (NMOS) transistor. FIG. 6 is a circuit schematic illustrating a voltage regulator having an n-channel transistor with a configurable feedback path according to one embodiment of the disclosure. A voltage regulator 600, such as a linear regulator, may receive the supply voltage $V_{DD}$ at input node 302, the reference voltage $V_{REF}$ at input node 304, and a ground 306. An output of the voltage regulator 600 may provide an output voltage $V_{OUT}$ and be coupled to the output node 308.

The regulator 600 may include an amplifier 612 coupled to a transistor 614. An output of the amplifier 612 may be coupled to a gate 614A of the transistor 614. A source 614B of the transistor 614 may be coupled to the output node 308. The transistor 614 may drive current from the input node 302 to the output node 308 to obtain a desired voltage level at the output node 308. A feedback path 620 may couple the source 614B to the gate 614A through, for example, a switch 624 and a capacitor 622. A second feedback path 630 may be coupled between the source 614B and a terminal of the amplifier 612. Also coupled to the gate 614A may be current sources 662 and 664 and a current mirror 670. The current mirror 670 may include a transistor 666 coupled to the current source 662 and a transistor 668 coupled to the current source 664. When the feedback path 620 is activated, such as by turning on the switch 624, the current sources 662 and 664 and the current mirror 670 operate to increase a voltage across the source 614B and the gate 614A of the transistor 614.

A controller 640 may be coupled to the switch 624 of the feedback path 620 and configured to activate and de-activate the feedback path 620. The controller 640 may operate similar to the controller 340 of FIG. 3 and execute portions or all of the method illustrated in the flow chart of FIG. 4. For example, the controller 640 may detect a load transient on the voltage regulator 600 and activate the feedback path 620. A duration of time after activation, the controller 640 may de-activate the feedback path 620, such as when the voltage regulator 600 returns to nearly steady-state operation or after a fixed duration of time.

Activation of the feedback path 620 may increase a gate-source voltage $V_{GS}$ of the transistor 614 by driving current to the gate 614A to increase the voltage at the gate 614A relative to the source 614B. After the feedback path 620 is activated, a load transient may cause a voltage at the source 614B to decrease. This decrease causes a current of amount dI to flow through the capacitor 622. Current 666A through transistor 666 thus decreases from supply current I at source 662 by current amount dI to I−dI. Likewise, a current 668A through transistor 668 decreases from supply current n*I at source 664 by current amount n*dI to n*I−n*dI, where n is a ratio of channel size between the transistor 666A and 668A. The continued drive of current amount n*I from source 664 causes current to flow to the gate 614A and increase the voltage at the gate 614A.

Figure 7:
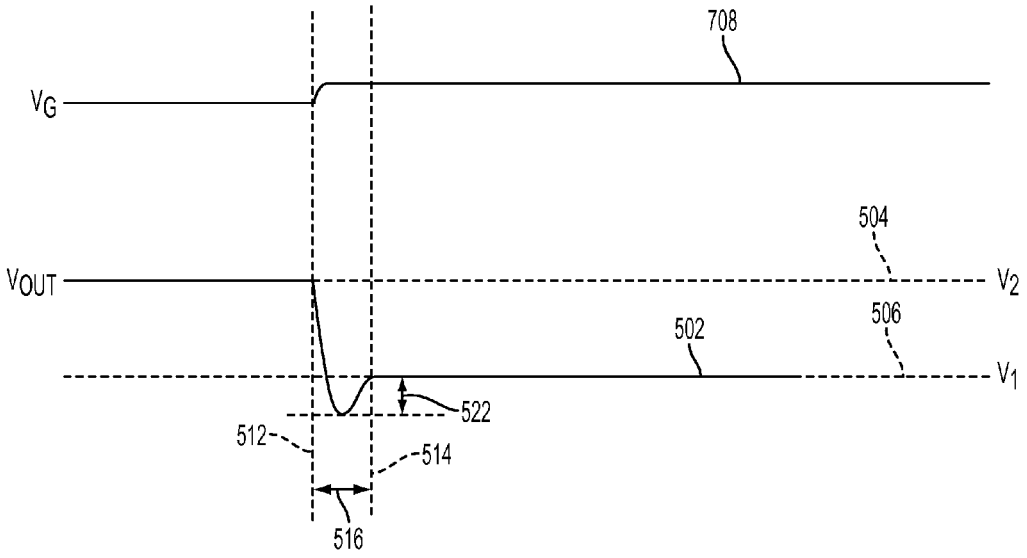
FIG. 7 is a graph illustrating a voltage output at an output node of a voltage regulator having an n-channel transistor with a configurable feedback path according to one embodiment of the disclosure

Operation of the circuit of FIG. 6 may be explained with the graphs shown in FIG. 7 produced according to one embodiment of operation of the circuit of FIG. 6. FIG. 7 is a graph illustrating a voltage output at an output node of a voltage regulator having an n-channel transistor with a configurable feedback path according to one embodiment of the disclosure. The circuit of FIG. 6 may produce a similarly small and short voltage droop 522 during time period 516 as the circuit of FIG. 3. However, the reduced droop may be obtained by increasing a gate voltage $V_G$ at gate 614A shown in line 708 of the n-channel transistor 614.

In one embodiment, the feedback paths described above with reference to FIG. 3 and FIG. 6 may be implemented in low power voltage regulators. Feedback paths to provide fast response to transients in low power regulators are desirable because low power regulators often respond slower to transients than high power regulators. In some embodiments, a low power voltage regulator may be a voltage regulator that consumes less than approximately 100 microAmperes, and in certain embodiments less than approximately 1.5 microAmperes.

If implemented in firmware and/or software, the functions described above, such as functionality described with reference to FIG. 4, may be stored as one or more instructions or code on a computer-readable medium. Examples include non-transitory computer-readable media encoded with a data structure and computer-readable media encoded with a computer program. Computer-readable media includes physical computer storage media. A storage medium may be any available medium that can be accessed by a computer. By way of example, and not limitation, such computer-readable media can comprise random access memory (RAM), read-only memory (ROM), electrically erasable programmable read-only memory (EEPROM), compact disc-read only memory (CD-ROM) or other optical disk storage, magnetic disk storage or other magnetic storage devices, or any other medium that can be used to store desired program code in the form of instructions or data structures and that can be accessed by a computer. Disk and disc includes compact discs (CD), laser discs, optical discs, digital versatile discs (DVD), floppy disks and blu-ray discs. Generally, disks reproduce data magnetically, and discs reproduce data optically. Combinations of the above should also be included within the scope of computer-readable media.

In addition to storage on computer readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

Although the present disclosure and certain representative advantages have been described in detail, it should be understood that various changes, substitutions and alterations can be made herein without departing from the spirit and scope of the disclosure as defined by the appended claims. For example, although signals generated by a controller are described throughout as "high" or "low," the signals may be inverted such that "low" signals turn on a switch and "high" signals turn off a switch. Moreover, the scope of the present application is not intended to be limited to the particular embodiments of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. An apparatus, comprising:

a voltage regulator, comprising:

a transistor comprising a gate, a source, and a drain;

an amplifier comprising an input node and an output node, wherein the output node is coupled to the gate of the transistor; and a first feedback path coupling one of the source and the drain of the transistor to the gate of the transistor, wherein the first feedback path is configured to activate and de-activate, wherein the first feedback path is configured to activate after a load transient on the voltage regulator, and wherein the first feedback path is configured to de-activate during steady-state operation of voltage regulator.

2. The apparatus of claim 1, further comprising a second feedback path coupling one of the source and the drain of the transistor to the input node of the amplifier.

3. The apparatus of claim 1, further comprising a controller coupled to the first feedback path and configured to:

de-activate the first feedback path during steady-state operation of the voltage regulator; and activate the first feedback path during a load transient on the one of the source and the drain of the transistor, wherein the first feedback path remains active for a duration of time after the load transient.

4. The apparatus of claim 1, wherein the first feedback path comprises:

a switch; and a capacitor, wherein the switch and the capacitor are coupled in series between the gate of the transistor and the one of the source and the drain of the transistor.

5. The apparatus of claim 1, wherein the transistor comprises a p-channel metal-oxide-semiconductor (PMOS) transistor.

6. The apparatus of claim 5, wherein the voltage regulator comprises a low-dropout regulator (LDO).

7. The apparatus of claim 1, wherein the transistor comprises an n-channel metal-oxide-semiconductor (NMOS) transistor.

8. The apparatus of claim 7, wherein the voltage regulator comprises a linear voltage regulator.

9. The apparatus of claim 7, further comprising a current mirror coupled to the feedback path.

10. A method, comprising:

detecting a load transient on a voltage regulator having a transistor;

activating, after detecting the load transient, a feedback path between one of a drain and a source of the transistor and a gate of the transistor; and de-activating the feedback path after a duration of time after the load transient such that the feedback path is not active during steady-state operation of the voltage regulator.

11. The method of claim 10, wherein the step of activating the feedback path comprises toggling a switch in the feedback path to couple a capacitor between the gate of the transistor and the one of the drain and the source of the transistor.

12. The method of claim 11, wherein the step of activating the feedback path comprises increasing a gate-to-source voltage of the transistor using the capacitor, wherein the voltage regulator comprises a low-dropout (LDO) regulator.

13. The method of claim 11, wherein the step of activating the feedback path comprises increasing a gate-to-source voltage of the transistor using a current mirror, wherein the voltage regulator comprises a linear voltage regulator.

14. The method of claim 10, wherein the step of de-activating the feedback path comprises de-activating the feedback path after a predetermined duration of time.

15. The method of claim 10, wherein the step of detecting the load transient comprises detecting a switching from another voltage regulator to the voltage regulator at an output node shared by the voltage regulator and the other voltage regulator.

16. The method of claim 15, wherein the step of detecting the switching from another voltage regulator to the voltage regulator comprises detecting a switching from a first low-dropout regulator (first LDO) to a second low-dropout regulator (second LDO).

17. An apparatus, comprising:

a voltage regulator comprising:

a transistor; and a feedback path between one of a drain and a source of a transistor and a gate of the transistor; and a controller coupled to the voltage regulator, wherein the controller is configured to execute the steps of:

detecting a load transient on the voltage regulator;

activating, after detecting the load transient, the feedback path; and de-activating the feedback path after a duration of time after the load transient such that the feedback path is not active during steady state operation of the voltage regulator.

18. The apparatus of claim 17, wherein the feedback path comprises:

a switch; and a capacitor, wherein the switch and the capacitor are coupled in series between the gate of the transistor and the one of the source and the drain of the transistor; and wherein the controller is configured to activate the feedback path by toggling the switch.

19. The apparatus of claim 17, wherein the voltage regulator is configured to couple to a load, wherein the apparatus further comprises another voltage regulator configured to couple to the load, and wherein the controller is further configured to detect the load transient by detecting a switch in operation from the other voltage regulator to the voltage regulator.

20. The apparatus of claim 19, wherein the voltage regulator and the other voltage regulator are configured to couple to a microphone bias output node.

21. The apparatus of claim 17, wherein the transistor comprises an n-channel metal-oxide-semiconductor (NMOS) transistor, and wherein the feedback path further comprises a current mirror configured to increase a gate-to-source voltage of the NMOS transistor when the feedback path is active.

* * * * *